US008333088B2

(12) United States Patent
Taras et al.

(10) Patent No.: US 8,333,088 B2
(45) Date of Patent: Dec. 18, 2012

(54) HEAT EXCHANGER DESIGN FOR IMPROVED PERFORMANCE AND MANUFACTURABILITY

(75) Inventors: Michael F. Taras, Fayetteville, NY (US); Alexander Lifson, Manilus, NY (US)

(73) Assignee: Carrier Corporation, Farmington, CT (US)

( * ) Notice: Subject to any disclaimer, the term of this patent is extended or adjusted under 35 U.S.C. 154(b) by 931 days.

(21) Appl. No.: 12/443,889

(22) PCT Filed: Dec. 26, 2006

(86) PCT No.: PCT/US2006/049299

§ 371 (c)(1),
(2), (4) Date: Apr. 1, 2009

(87) PCT Pub. No.: WO2008/079135

PCT Pub. Date: Jul. 3, 2008

(65) Prior Publication Data

US 2010/0011804 A1 Jan. 21, 2010

(51) Int. Cl.
*F25B 39/02* (2006.01)

(52) U.S. Cl. ..... 62/515

(58) Field of Classification Search ..... 62/509, 62/515; 165/176, 178

See application file for complete search history.

(56) References Cited

U.S. PATENT DOCUMENTS 5,046,555 A * 9/1991 Nguyen ..... 165/173
5,069,277 A 12/1991 Nakamura
5,211,221 A * 5/1993 Lease ..... 165/150
5,826,649 A * 10/1998 Chapp et al. ..... 165/174
5,918,667 A 7/1999 Chiba et al.
5,941,303 A 8/1999 Gowan et al.

FOREIGN PATENT DOCUMENTS

DE 3803885 A1 8/1989

OTHER PUBLICATIONS

International Preliminary Report on Patentability mailed Mar. 16, 2010.

Search Report and Written Opinion mailed on Oct. 3, 2007 for PCT/US2006/49299.

* cited by examiner

*Primary Examiner* — Melvin Jones

(74) *Attorney, Agent, or Firm* — Carlson, Gaskey & Olds, PC

(57) ABSTRACT

A parallel flow heat exchanger is disclosed having heat transfer tubes with a plurality of relatively small channels, which are aligned in a parallel manner, and wherein the heat transfer tubes are in fluid communication with at least one manifold structure, are received in manifold wall openings and are attached to the manifold structure by brazing process The manifold walls and/or the tubes are modified to minimize the likelihood of brazing material plugging or at least partially blocking any of the plurality of channels In one feature, the openings in the manifold structure are formed by deforming the material of the manifold structure outwardly In another feature, the edges of the heat transfer tubes may be formed such that the outermost end channels within each heat transfer tube extend farther inwardly than do the central channels Various design configurations are disclosed.

19 Claims, 2 Drawing Sheets

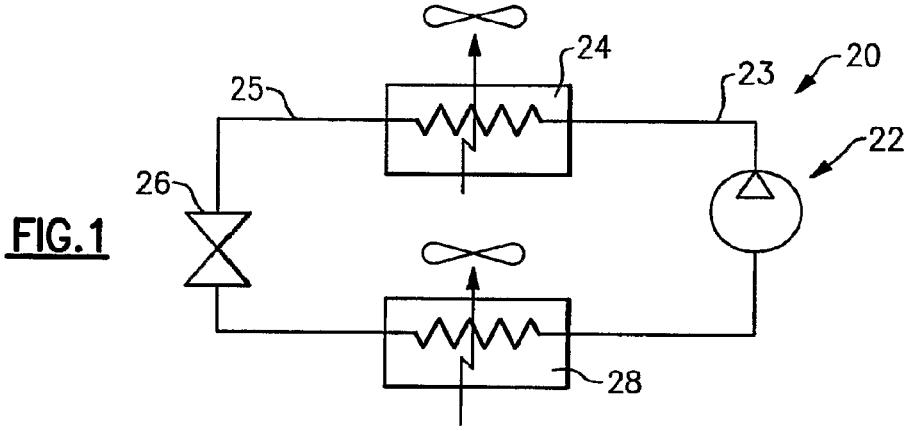
FIG.1
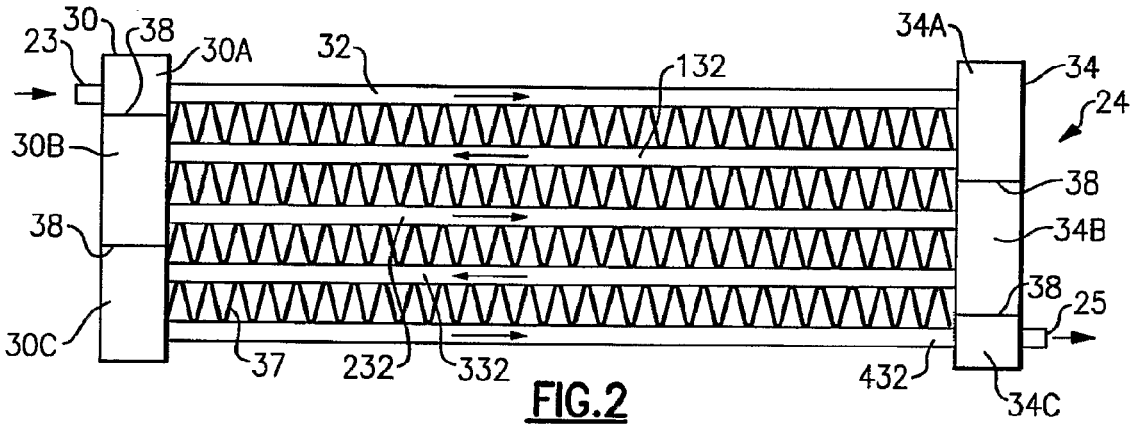
FIG.2
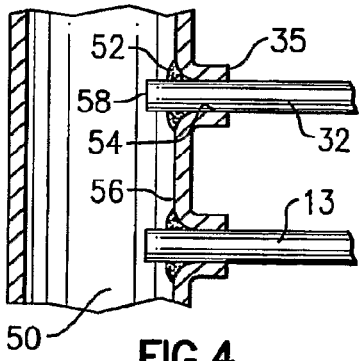
FIG.4
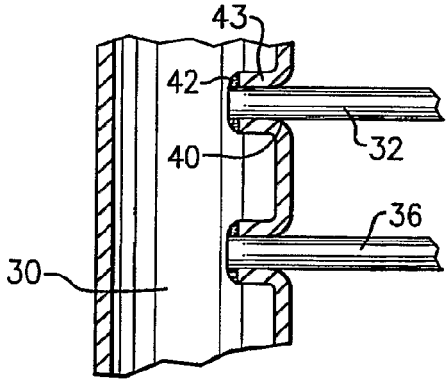
FIG.3A
Prior Art
FIG.3C
Prior Art
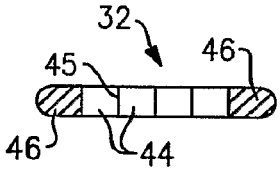

HEAT EXCHANGER DESIGN FOR IMPROVED PERFORMANCE AND MANUFACTURABILITY

This application is a United States National Phase application of PCT Application No. PCT/US2006/049299 filed Dec. 26, 2006.

BACKGROUND OF THE INVENTION

This application relates to a parallel flow heat exchanger, wherein parallel tubes are configured and mounted in a manifold in a manner that minimizes brazing material blocking channels in the tubes.

Refrigerant systems utilize a refrigerant to condition a secondary fluid, such as air, delivered to a climate controlled space. In a basic refrigerant system, the refrigerant is compressed in a compressor, and flows downstream to a heat exchanger (a condenser for subcritical applications and a gas cooler for transcritical applications), where heat is typically rejected from the refrigerant to ambient environment, during heat transfer interaction with this ambient environment. Then refrigerant flows through an expansion device, where it is expanded to a lower pressure and temperature, and to an evaporator, where during heat transfer interaction with another secondary fluid (e.g., indoor air), the refrigerant is evaporated and typically superheated, while cooling and often dehumidifying this secondary fluid.

In recent years, much interest and design effort has been focused on the efficient operation of the heat exchangers (e.g., condensers, gas coolers and evaporators) in the refrigerant systems. One relatively recent advancement in the heat exchanger technology is the development and application of parallel flow, or so-called microchannel or minichannel, heat exchangers (these two terms will be used interchangeably throughout the text), as the condensers and evaporators.

These heat exchangers are provided with a plurality of parallel heat transfer tubes, typically of a non-round shape, among which refrigerant is distributed and flown in a parallel manner. The heat transfer tubes are orientated generally substantially perpendicular to a refrigerant flow direction in the inlet, intermediate and outlet manifolds that are in flow communication with the heat transfer tubes. The primary reasons for the employment of the parallel flow heat exchangers, which usually have aluminum furnace-brazed construction, are related to their superior performance, high degree of compactness, structural rigidity and enhanced resistance to corrosion.

In many cases, these heat exchangers are designed for a multi-pass configuration, typically with a plurality of parallel heat transfer tubes within each refrigerant pass, in order to obtain superior performance by balancing and optimizing heat transfer and pressure drop characteristics. In such designs, the refrigerant that enters an inlet manifold (or so-called inlet header) travels through a first multi-tube pass across a width of the heat exchanger to an opposed, typically intermediate, manifold. The refrigerant collected in a first intermediate manifold reverses its direction, is distributed among the heat transfer tubes in the second pass and flows to a second intermediate manifold. This flow pattern can be repeated for a number of times, to achieve optimum heat exchanger performance, until the refrigerant reaches an outlet manifold (or so-called outlet header). Obviously, in a single-pass configuration, the refrigerant travels only once across the heat exchanger core from the inlet manifold to the outlet manifold. Typically, the individual manifolds are of a cylindrical shape (although other shapes are also known in the art) and are represented by different chambers separated by partitions within the same manifold construction assembly.

Heat transfer corrugated and typically louvered fins are placed between the heat transfer tubes for outside heat transfer enhancement and construction rigidity. These fins are typically attached to the heat transfer tubes during a furnace braze operation. Furthermore, each heat transfer tube preferably contains a plurality of relatively small parallel channels for in-tube heat transfer augmentation and structural rigidity.

In the prior art, the openings to receive the multi-channel tubes are formed in a manifold wall by punching the wall inwardly. The heat transfer tubes are inserted into these openings, but do not extend much further into the manifold past the ends of the punched material, since it would create additional impedance for the refrigerant flow within the manifold, promote refrigerant maldistribution and degrade heat exchanger performance. Since the heat transfer tube edges are located at approximately the same positions as the ends of the punched material of the manifold openings, brazing material has a high potential of flowing into some of the channels during the brazing process and blocking these channels. This is, of course, undesirable and should be avoided, since at least partially blocked heat transfer tubes are not utilized to their full heat transfer potential, have additional hydraulic resistance on the refrigerant side and promote refrigerant maldistribution conditions. All these factors negatively impact heat exchanger performance.

SUMMARY OF THE INVENTION

In one disclosed feature of this invention, the heat exchanger manifold openings for insertion of heat transfer tubes are punched outwardly of the manifold wall. Therefore, the heat transfer tubes can be inserted into the openings, and extend just slightly beyond the wall of the manifold, and far beyond the manifold opening ends, such that channels in the heat transfer tubes are unlikely to be blocked by brazing material during the brazing process. Moreover, a relatively gradually curved interface is formed between the manifold openings and the heat transfer tube edges to serve as a well to receive the brazing material.

In a separate feature of this invention, the shape of the heat transfer tube edges is varied such that it is not a straight line, but is rather represented by a shape that closely follows and resembles the curvature of the manifold wall. For instance, the heat transfer tube edges can have a circular shape, piecewise circular shape, elliptical shape, etc. or have a triangular cutout, rectangular cutout, trapezoidal cutout, etc. Many variations and combinations of these basic shapes are feasible and within the scope of the invention. In this manner, the heat transfer tubes can extend beyond the punched material of the heat exchanger manifold openings without blocking refrigerant flow, as they have the designed-in recesses in the center channels allowing the end channels of heat transfer tubes penetrate further into the manifold. Therefore, the end channels, that are most likely to be plugged by the brazing material during the brazing process, can extend farther into the manifold beyond the manifold opening ends. This eliminates channel blockage by the brazing material, while not introducing any additional undesired hydraulic impedance to the refrigerant flow in the manifold. As a result, refrigerant maldistribution conditions are avoided, the entire heat transfer surface is fully utilized, pressure drop through the heat exchanger is reduced and the heat exchanger performance is improved.

These and other features of the present invention can be best understood from the following specification and drawings, the following of which is a brief description.

BRIEF DESCRIPTION OF THE DRAWINGS

FIG. 1 is a schematic view of a refrigerant system.

FIG. 2 is a cross-sectional view of a parallel flow heat exchanger.

FIG. 3A shows a feature of the prior art manifold assembly.

FIG. 3C shows the prior art heat transfer tube with end channels blocked by the brazing material.

FIG. 4 shows one inventive feature.

DETAILED DESCRIPTION OF THE PREFERRED EMBODIMENTS

Figure 5:
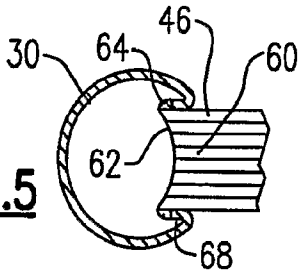
FIG. 5 shows a first embodiment of a second inventive feature.

A basic refrigerant system 20 is illustrated in FIG. 1 and includes a compressor 22 delivering refrigerant into a discharge line 23 leading to a heat exchanger (a condenser for subcritical applications and a gas cooler for transcritical applications) 24. The heat exchanger 24 is a parallel flow heat exchanger, and in one disclosed embodiment, is a microchannel heat exchanger. The heat is transferred in the heat exchanger 24 from the refrigerant to a secondary loop fluid, such as ambient air. The high pressure, but cooled, refrigerant passes into a refrigerant line 25 downstream of the heat exchanger 24 and through an expansion device 26, where it is expanded to a lower pressure and temperature. Downstream of the expansion device 26, refrigerant flows through an evaporator 28 and back to the compressor 22. The evaporator 28 is a parallel flow heat exchanger, and in one disclosed embodiment, is a microchannel heat exchanger. Although a basic refrigerant system 20 is shown in FIG. 1, it is well understood by a person ordinarily skilled in the art that many options and features may be incorporated into a refrigerant system design. All these refrigerant system configurations are well within the scope and can equally benefit from the invention.

The parallel flow heat exchanges 24 and 28 may have a single-pass configuration or a multi-pass configuration. A single-pass configuration is more typical for the parallel flow evaporators, while a multi-pass configuration is frequently used for the parallel flow condensers and gas coolers. Although FIG. 2 depicts an exemplary embodiment of a multi-pass (5-pass) parallel flow condenser or a gas cooler, as known to a person ordinarily skilled in the art, many design variations of parallel flow heat exchangers are feasible and would be within the scope of the invention. As shown in FIG. 2, the multi-pass parallel flow condenser or gas cooler 24 has a manifold structure 30 that consists of multiple chambers 30A, 30B, and 30C, as well as a manifold structure 34 that consists of multiple chambers 34A, 34B, and 34C, and positioned at an opposite end of the heat exchanger core. The inlet manifold chamber 30A receives the refrigerant from the discharge line 23. The refrigerant flows into a first bank of parallel heat transfer tubes 32, and then across the heat exchanger core to the intermediate manifold chamber 34A. From the intermediate manifold chamber 34A, the refrigerant flows through a second bank of parallel heat transfer tubes 132, in an opposite direction, to the intermediate manifold chamber 30B. In a similar manner, the refrigerant flows between the intermediate manifold chambers 30B and 34B, through a third bank of parallel heat transfer tubes 232, and between the intermediate manifold chambers 34B and 30C, through a forth bank of parallel heat transfer tubes 332. Finally, from the intermediate manifold chamber 30C, the refrigerant flows to the outlet manifold chamber 34C, through a fifth bank of parallel heat transfer tubes 432, and to the refrigerant line 25. It should be noted that, in practice, there may be more or less refrigerant passes than the illustrated passes 32, 132, 232, 332, and 432. Further, it should be understood that, although for simplicity purposes each refrigerant pass is represented by a single heat transfer tube, typically, there are many heat transfer tubes within each pass amongst which refrigerant is distributed while flowing within the pass. In the multi-pass condenser and gas cooler applications, a number of the parallel heat transfer tubes within each bank typically decreases in a downstream direction, with respect to a refrigerant flow. On the other hand, in the multi-pass evaporator applications, a number of parallel heat transfer tubes in each bank generally increases in a downstream direction, with respect to a refrigerant flow. Separator plates 38 are placed within the manifold structures 30 and 34 to separate the chambers 30A, 30B, 30C and the chambers 34A, 34B, and 34C respectively. Obviously, in single-pass parallel flow heat exchanger configurations, manifold structures 30 and 34 would have only single chambers, in particular, the inlet chamber 34A within the manifold structure 30 and the outlet chamber 34C within the manifold structure 34.

Figure 3B:
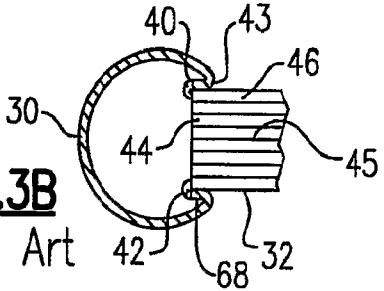
FIG.3B Prior Art
FIG. 3B shows a top view of the prior art manifold assembly shown in FIG. 3A.

As shown in FIG. 3A, in the prior art, there has been a problem associated with positioning and brazing the heat transfer tubes 32 (as well as heat transfer tubes 132, 232, 332, and 432) into the manifold structure 30 (as well as into the manifold structure 34). As shown, manifold openings 40 for receiving the heat transfer tubes 32 are formed by punching the material of the wall of the manifold 30 inwardly. This makes a portion of material 43 for the manifold openings extending into the flow passage within the manifold structure 30. A brazing material 42 is then positioned between the material of the heat transfer tubes 32 and the manifold material 43, and secures the heat transfer tubes 32 within the manifold structure 30, during a brazing process. A problem can occur with this prior art design, as is shown in FIG. 3B. As shown in FIG. 3B, the heat transfer tube 32 has a plurality of relatively small channels (so-called microchannels or minichannels) 44 that are aligned in a parallel manner into the plane of the paper in the FIG. 3A view. Internal walls or fins 45 separate the small parallel channels 44. The fins 45 are placed between the channels 44 for structural rigidity and heat transfer enhancement. Such microchannel or minichannel heat exchangers are becoming more widely utilized in the air conditioning and refrigeration art and beyond. However, in the conventional interface design between the heat transfer tubes 32 and the manifold structure 30 shown in FIG. 3B, the outermost end channels 46 can be blocked by the brazing material 42, since the edges of the heat transfer tubes 32 are relatively close to the forward ends of the punched material 43 of the manifold openings 40. Thus, as shown schematically at FIG. 3C, the outermost channels 46 may become at least partially blocked or plugged with the brazing material 42. This is undesirable, since it would create additional impedance for the refrigerant flow through the heat transfer tubes, reduce heat transfer due to only partial utilization of the heat transfer surface, promote refrigerant maldistribution conditions and degrade the heat exchanger performance. Extending the heat transfer tubes 32 farther inside the manifold 30 is also undesirable, since additional refrigerant pressure drop within the manifold 30 and potential refrigerant maldistribution make a negative impact on the heat exchanger performance.

FIG. 4 shows a first feature of the present invention. In FIG. 4, the manifold openings 54 are formed by deforming material of the wall 56 of the manifold 50 outwardly. Now, the heat transfer tubes 32 may have their edges 58 just slightly extending inwardly of the wall of the manifold 50, but positioned farther away from the edges of the manifold openings 54. The brazing material 52 is at the interface locations, between the manifold openings 54 and the heat transfer tube edges 58, that is gradually curved away from the heat transfer tube edges 58, and thus is positioned in a well or cavity. The edges 58 of the heat transfer tubes 32 minimally extend inwardly of the manifold 50 without unduly blocking refrigerant flow within the manifold. Thus, the problems as mentioned above are addressed by this feature.

Other modifications to the heat transfer tube provide further relief from the likelihood of brazing material blocking the channels. The features shown in FIGS. 5-8 may be utilized in conjunction with, or in place of, the features shown in FIG. 4.

As shown in FIG. 5, the edge of a heat transfer tube 60 can have a curvature that generally follows the manifold cross-section shape, as shown at 62, such that the outermost end channels 46, which are the ones most likely to be plugged or at least partially blocked with the brazing material, can extend further into the manifold 30 and away from the ends of the manifold openings 68, preventing blockage of these outmost end channels 46 by the brazing material 64, while the curvature 62 provides a recess in the center section of the manifold 30 that relieves the abstraction to the refrigerant flow within the manifold, as mentioned above. For instance, the heat transfer tube edge 62 can be of a circular shape, a piecewise circular shape, an elliptical shape or any other shape having a curvature.

Figure 6:
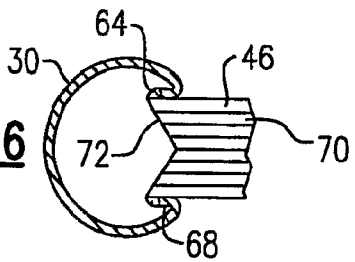
FIG. 6 shows a second embodiment of the second inventive feature.

Analogously, FIG. 6 shows a heat transfer tube 70 having a triangular cutout 72 at the edge that provides similar benefits to the curvature 62 of FIG. 5 embodiment.

Figure 7:
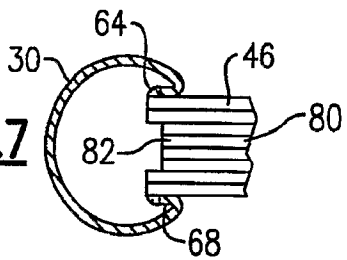
FIG. 7 shows a third embodiment of the second inventive feature.

FIG. 7 shows a heat transfer tube 80 having a rectangular cutout 82 providing the same function.

Figure 8:
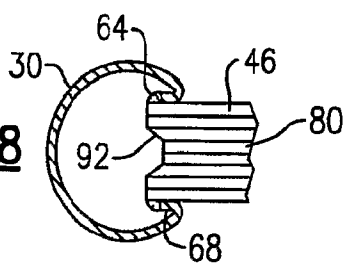
FIG. 8 shows a fourth embodiment of the second inventive feature.

FIG. 8 shows a tube 90 having a trapezoidal cutout 92 that provides similar functionality to the FIG. 5-7 embodiments.

It should be noted that any combination of the FIG. 5-8 embodiments is also within the scope of the invention.

Figure 9:
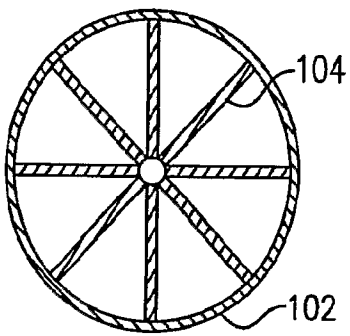
FIG. 9 shows a fifth embodiment of the second inventive feature.

Also, heat transfer tubes of other shapes or cross-sections can benefit from the invention. For instance, as shown in FIG. 9, a round tube 102 having internal heat transfer enhancement elements 104 can take advantage of the invention, in a similar manner. Furthermore, the invention extends to other manifold shapes and cross-sections. Lastly, the invention offers similar benefits in other applications, outside the scope of air conditioning and refrigeration art, where any other fluid can flow inside the channels of parallel heat transfer tubes. Lastly, any other manufacturing process utilizing the material, such as, for instance, solder or glue, securing the heat transfer tubes to the manifold, that is initially fluent and then solidifies, during this attachment manufacturing process, can equally benefit from the invention.

In summary, the present invention provides a variety of ways to minimize the blockage of channels in microchannel heat exchangers by the brazing or other securing material, resulting in avoiding refrigerant (or other fluid) maldistribution conditions, entire heat transfer surface utilization, in-tube pressure drop reduction through the heat exchanger and improved heat exchanger performance.

While preferred embodiments of this invention have been disclosed, a worker of ordinary skill in the art would recognize that certain modifications would come within the scope of this invention. For that reason the following claims should be studied to determine the true scope and content of this invention.

What is claimed is:

1. A heat exchanger comprising:

a pair of spaced manifold structures, and a plurality of heat transfer tubes extending between said manifold structures in generally parallel relationship with each other and being in fluid communication with said manifold structures, each of said heat transfer tubes having a plurality of parallel channels spaced from each other, and said heat transfer tubes being inserted in openings in said manifold structures, said heat transfer tubes being secured to said manifold structures by an initially fluent and then solidifying securing material, and there being modifications to at least one of said manifold structures and said heat transfer tubes to minimize the likelihood of said securing material at least partially blocking any of said plurality of channels; and a working fluid to flow inside said heat transfer tubes is one of a refrigerant, air, water, glycol solution, oil, air, nitrogen, helium, petrochemical gas and combination thereof.

2. The heat exchanger as set forth in claim 1, wherein said securing material is one of brazing material, solder material and glue material.

3. The heat exchanger as set forth in claim 2, wherein said securing material is deposited within an internal passage in said manifold structures to secure said heat transfer tubes within said manifold structure.

4. The heat exchanger as set forth in claim 1, wherein said openings are formed in said manifold structures by deforming the material of said manifold structures outwardly away from an internal passage in said manifold structures such that said heat transfer tubes do not extend inwardly of said manifold structures passing farther beyond a wall of said manifold structures.

5. The heat exchanger as set forth in claim 1, wherein edges of said heat transfer tubes are shaped such that laterally outermost channels of said plurality of parallel channels extend inwardly farther beyond said manifold walls then do more centrally located channels of said plurality of parallel channels.

6. The heat exchanger as set forth in claim 5, wherein edges of said heat transfer tubes are shaped to have one of a triangular cutout, a rectangular cutout and a trapezoidal cutout such that the laterally outermost channels of said plurality of parallel channels extend farther inwardly passing beyond said manifold walls than centrally located channels of said plurality of parallel channels.

7. The heat exchanger as set forth in claim 1, wherein edges of said heat transfer tubes are shaped to have a curvature such that it generally follows and resembles a manifold curvature.

8. The heat exchanger as set forth in claim 1, wherein said heat transfer tube edges have a curvature of one of a circle and an ellipse.

9. A heat exchanger comprising:

a pair of spaced manifold structures, and a plurality of heat transfer tubes extending between said manifold structures in generally parallel relationship with each other and being in fluid communication with said manifold structures, each of said heat transfer tubes having a plurality of parallel channels spaced from each other, and said heat transfer tubes being inserted in openings in said manifold structures, said heat transfer tubes being secured to said manifold structures by an initially fluent and then solidifying securing material, and there being modifications to at least one of said manifold structures and said heat transfer tubes to minimize the likelihood of said securing material at least partially blocking any of said plurality of channels; and said heat transfer tube material and said manifold material is one of copper and aluminum.

10. The heat exchanger as set forth in claim 9, wherein a working fluid to flow inside said heat transfer tubes is one of a refrigerant, air, water, glycol solution, oil, air, nitrogen, helium, petrochemical gas and combination thereof.

11. A refrigerant system comprising:

a compressor, a heat rejecting heat exchanger, an expansion device, and an evaporator; and at least one of said evaporator and said heat rejecting heat exchanger including a pair of spaced manifold structures, and a plurality of heat transfer tubes extending between said manifold structures in generally parallel relationship with each other and being in fluid communication with said manifold structures, each of said heat transfer tubes having a plurality of parallel channels spaced from each other, and said heat transfer tubes being inserted in openings in said manifold structures, said heat transfer tubes being secured to said manifold structures by an initially fluent and then solidifying securing material, and there being modifications to at least one of said manifold structures and said heat transfer tubes to minimize the likelihood of said securing material at least partially blocking any of said plurality of channels, while the heat exchanger performance is not compromised; and said securing material is one of brazing material, solder material and glue material.

12. The refrigerant system as set forth in claim 11, wherein said securing material is deposited within an internal passage in said manifold structures to secure said heat transfer tubes within said manifold structure.

13. The refrigerant system as set forth claim 11, wherein said heat transfer tubes have one of a rectangular, oval, flatten circle, racetrack, elliptical or circular cross-section.

14. The refrigerant system as set forth in claim 12, wherein said openings are formed in said manifold structures by deforming the material of said manifold structures outwardly away from an internal passage in said manifold structures such that said heat transfer tubes do not extend inwardly of said manifold structures passing farther beyond a wall of said manifold structures.

15. The refrigerant system as set forth in claim 12, wherein edges of said heat transfer tubes are shaped such that laterally outermost channels of said plurality of parallel channels extend inwardly farther beyond said manifold walls then do more centrally located channels of said plurality of parallel channels.

16. The refrigerant system as set forth in claim 15, wherein edges of said heat transfer tubes are shaped to have one of a triangular cutout, a rectangular cutout and a trapezoidal cutout such that the laterally outermost channels of said plurality of parallel channels extend farther inwardly passing beyond said manifold walls than centrally located channels of said plurality of parallel channels.

17. The refrigerant system as set forth in claim 11, wherein edges of said heat transfer tubes are shaped to have a curvature such that it generally follows and resembles a manifold curvature.

18. The refrigerant system as set forth in claim 11, wherein said heat transfer tube edges have a curvature of one of a circle and an ellipse.

19. The refrigerant system as set forth in claim 11, wherein said heat transfer tube material and said manifold material is one of copper and aluminum.

* * * * *